US005392861A

United States Patent [19]

Champagne

[11] Patent Number: 5,392,861

[45] Date of Patent: Feb. 28, 1995

[54] RESIDUAL POLLUTION CONTAINMENT DEVICE AND METHOD OF CLEANING A WIRELINE

[76] Inventor: Paul Champagne, 1464 Dr. Beatrous Rd., Theriot, La. 70397

[21] Appl. No.: 206,340

[22] Filed: Mar. 7, 1994

[51] Int. Cl.[6] ..... E21B 19/08; E21B 33/08

[52] U.S. Cl. ..... 166/379; 166/77; 166/81; 166/84; 166/385

[58] Field of Search ..... 166/77, 81, 84, 85, 166/70, 385, 379

[56] References Cited

U.S. PATENT DOCUMENTS

| | | | |
|---|---|---|---|
| 2,630,180 | 3/1953 | Summers | 166/77 |
| 2,677,427 | 5/1954 | McKinney et al. | 166/77 |
| 2,720,266 | 10/1955 | Broussard et al. | 166/77 |
| 2,810,439 | 10/1957 | McCullough et al. | 166/77 |
| 3,145,995 | 8/1964 | Adamson et al. | 166/84 X |
| 3,363,880 | 1/1968 | Blagg | 166/77 X |
| 3,920,076 | 11/1975 | Laky | 166/77 X |
| 4,542,787 | 9/1985 | Parker | 166/84 |
| 5,188,173 | 2/1993 | Richardson et al. | 166/77 |

*Primary Examiner*—Hoang C. Dang
*Attorney, Agent, or Firm*—George A. Bode; Michael L. Hoelter

[57] ABSTRACT

A method and apparatus for cleaning the wireline used in a wireline wellhead operation so as to prevent any contaminants thereon from dripping onto the adjacent ground and/or equipment. The apparatus comprises a housing supported above a wireline wellhead, the housing has the wireline pass into and out of it and has a sheave therein for the wireline to pass over. The wireline passes through one or more drip collectors movable within the housing that have channels for directing contaminants that may fall from the sheave or wireline to a drain to remove the contaminants from the apparatus.

17 Claims, 6 Drawing Sheets

RESIDUAL POLLUTION CONTAINMENT DEVICE AND METHOD OF CLEANING A WIRELINE

BACKGROUND OF THE INVENTION

1. Field of the Invention

This invention pertains to oil and/or gas wireline wells and specifically to a means of controlling/containing pollution that may occur during the operation of the wireline wellhead.

2. General Background

In wireline wellheads, as the braided wire, cable, rope, or electric conductor enters or leaves the wellhead, it is quite common for a considerable amount of grease, oil, lubricants, toxins, or other contaminants to become attached to and then drip or otherwise come off the wireline, the top sheave and/or related apparatus. This may occur whether the well is pressurized or not and these unrestrained pollutants can eventually find their way into nearby water and/or soil. Additionally, these pollutants, by their nature, are slippery and can thus pose a risk to nearby workers since this material can spill onto stairwells, hand railing, and other nearby equipment and/or structures which are frequented by workers.

Some attempts to retain pollutants within wireline wells include the use of pack offs and/or oil strippers in non-pressurized wells. These devices strip the contaminants off the wireline as it is pulled out of the well. Additionally, there are grease injectors which pump grease or other high viscosity material into pressurized wells so as to maintain pressure therein. These grease injectors are typically used in conjunction with the aforesaid pack offs and/or oil strippers in order to restrain such contaminants within the well. Some such devices are described as follows.

U.S. Pat. No. 5,150,751 issued to Burton, et al., discloses one attempt to contain such pollutants by enclosing the uppermost region of a stuffing box of a well. Thus, any pollutants spilling out of the stuffing box, such as due to the packing therein becoming dried, worn, or damaged, will collect in the enclosure and be transported elsewhere. However, by only enclosing the uppermost region of the stuffing box, only pollutants from this region will be contained. Additionally, even though the wireline or cable passes through this enclosure, no means are disclosed to scrape or remove pollutants from this wireline or cable. Consequently, the contaminated wireline or cable will leave the enclosure thereby dripping and discharging such pollutants outside the enclosure.

U.S. Pat. No. 4,530,397 issued to Calhoun discloses an apparatus that is secured to the upper region of a stuffing box of a polished rod oil well pump. It is used to contain any oil leakage should the packing in the stuffing box become worn or dry out. This apparatus relies upon scraping such oil off the polished rod and does not take into consideration any oil that may drip down the polished rod nor is this apparatus applicable to wirelines since a wireline involves much more flexibility and degree of movement than a solid polished rod.

U.S. Pat. No. 5,211,227 issued to Anderson discloses a fugitive emission accumulator which is secured atop a stuffing box for capturing oil at the wellhead and returning it back to the well. This apparatus operates by wiping the fugitive oil from the emerging polish rod.

U.S. Pat. No. 4,665,976 issued to Retherford discloses a deflector shield assembly for use with a well pump incorporating a polished rod. This shield seals entirely around the stuffing box and the polished rod and serves the purpose of passively retaining any oil that may leak from the well.

U.S. Pat. No. 4,951,743 issued to Henderson discloses a flexible leakage protector, or bellows, that fits around the polished rod. As the polished rod reciprocates within the well, the bellows encloses such rod thereby preventing any leakage from occurring.

U.S. Pat. No. 3,322,198 issued to McHenry discloses a safety hood for installation around a wellhead or bonnet. This safety hood incorporates an opening in its upper region for the passage therethrough of a polished rod. Should a leak occur, such leakage will be contained within the hood. No steps are taken to actively stop any contaminant from escaping via the polished rod.

U.S. Pat. Nos. 3,186,722 and 3,270,810 both issued to Johnston discloses a wellhead enclosure with an upper flexible bellows surrounding a polished rod. Thus, as the polished rod reciprocates, it remains enclosed within the bellows.

U.S. Pat. No. 3,500,907 issued to Gentry discloses a closed or self-contained system whereby both the upper and lower lubricator sections are each secured to a separately located tank. The purpose of this system is to clean wireline tools without permitting toxins to escape into the atmosphere.

While each of the above disclose attempts at containing and/or cleaning wellhead tools, they primarily operate passively, i.e. they contain a leak should one arise rather than actively attempting to remove oil and gas from the components of a well that extend beyond the wellhead. Furthermore, those devices which do attempt to wipe oil off the polished rod before exposing it to the atmosphere, are not capable of similar operation with a wireline due to the greater flexibility and less rigidity of the wireline with respect to the polished rod and also the greater degree or angle of movement allowed by the wireline as compared to a polished rod. Additionally, these devices themselves become saturated and/or covered with contaminants thereby compromising their ability to retain such contaminants within the well. Also, the upper or top sheave that normally is suspended above these devices also becomes covered and saturated with pollutants thereby discharging same into the environment. Further, should the pressure control device (i.e., the grease injector assembly) experience a loss of pressure, a large volume of contaminants can spill or leak out under such pressure.

It is thus an object of this invention to provide a means of containing/controlling spills arising from a wireline wellhead, whether pressurized or not. Another object of this invention is to provide a means of allowing for the flexibility of the wireline while still providing for the cleaning of the wireline. Yet another object of this invention is to surround the stuffing box and top sieve so as to provide a means of containment should a leak occur or should there be an unexpected pressure release. Still another object of this invention is to enable the user to continue to use whatever containment devices are already installed on the wellhead. These and other objects and advantages will become obvious upon further investigation.

SUMMARY OF THE PRESENT INVENTION

The preferred embodiment of the apparatus of the present invention solves the aforementioned problems in a straightforward and simple manner. What is provided is a wireline wellhead containment enclosure that incorporates a housing having an interior and enclosing a sheave therein with this sheave being constructed and arranged for the passage of a wireline thereover. One or more wireline drip collector assemblies are located within and are secured to this housing. These wireline drip collector assemblies are configured for the passage of the wireline into and out of the housing. A channel forms a part of these wireline drip collector assemblies and they channel any collected contaminants to the interior of the housing for subsequent storage and/or delivery to a storage area. Located atop each wireline drip collector assembly are seal means that engage and guide the wireline as it passes through the wireline drip collector assembly. Whatever contaminants on the wireline thus drip down and are collected in the channel.

BRIEF DESCRIPTION OF THE DRAWING

For a further understanding of the nature and objects of the present invention, reference should be had to the following description taken in conjunction with the accompanying drawing in which like parts are given like reference numerals and, wherein.

DETAILED DESCRIPTION OF THE PREFERRED EMBODIMENT

Figure 1:
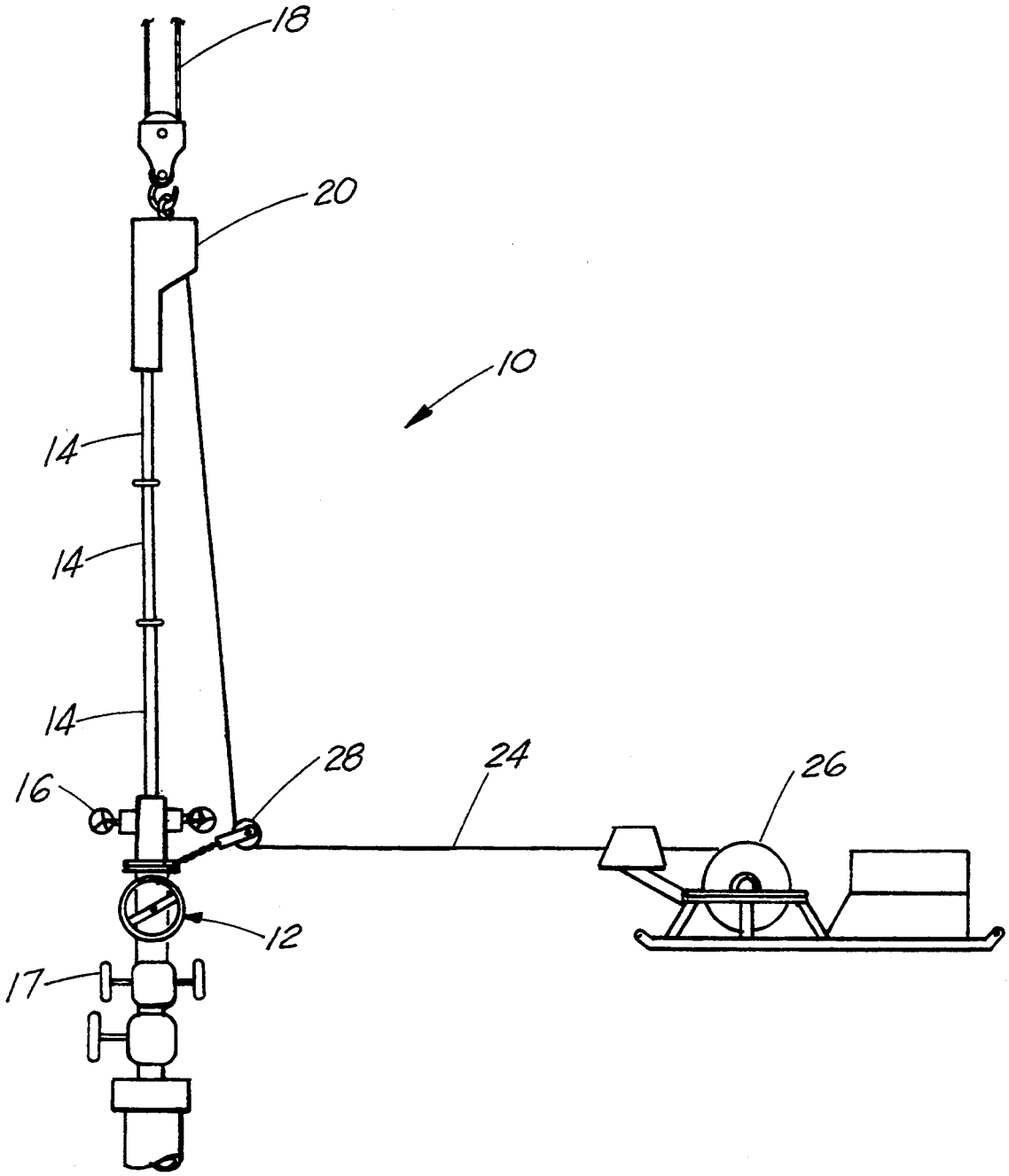
FIG. 1 is a pictorial view, partially broken away, of the overall installation and operation of the present invention.

Referring initially to FIG. 1, there is shown wireline wellhead system 10 incorporating wellhead or well tree 12 and several lubricator sections 14 atop wellhead 12. These lubricator sections 14 generally house wireline tools, so that the well can be opened and closed with such tools positioned above wellhead 12. Pressure control devices 32 supply a pressurized high viscosity substance (such as oil, grease, or other lubricants) so as to reduce friction and to retain pressure within the well. Secured between wellhead 12 and lubricator sections 14 for additional pressure control can be a series of manually operated clamps, rams, or seals 16 as needed. These clamps 16 will support any line or tools within the well in the event the more elevated lubricator sections 14 must be removed and/or closed. Clamp 17 is a tree valve engaged for closing off the entire well.

A load line of an adjacent crane 18 supports containment box 20 above both lubricator sections 14 and well head 12. Ideally, this containment box 20 would be supported from a single point of attachment 22. Containment box 20 is designed to contain residual oils, condensate, high-viscosity oil, greases, and other contaminants which are normally associated with or found in oil and gas wells, whether pressurized or not.

Passing out of containment box 20 is wireline 24 which may be an electric conductor wireline or a braided wireline or the like. Additionally, wireline 24 can consist of a single strand of steel line having a diameter in the range of 0.100 inch to about 0.190 inch, more or less.

Wireline 24, as shown, extends from containment box 20 to wireline unit 26 some distance away from well 12. Wireline unit 26 alternates between reeling in wireline 24 and letting wireline 24 out so as to mechanically insert and/or remove tools, valves, debris etc. from the well. A bottom sheave 28 secured to wellhead 12 is often employed to align wireline 24 with both wireline unit 26 and containment box 20.

Generally, load line of crane 18 would only support containment box 20 which can exceed 10,000 pounds in weight. The remaining components illustrated in FIG. 1 (i.e. lubricators 14 and clamps or seals 16, etc.) would typically be supported by or rest upon wellhead 12.

Figure 2:
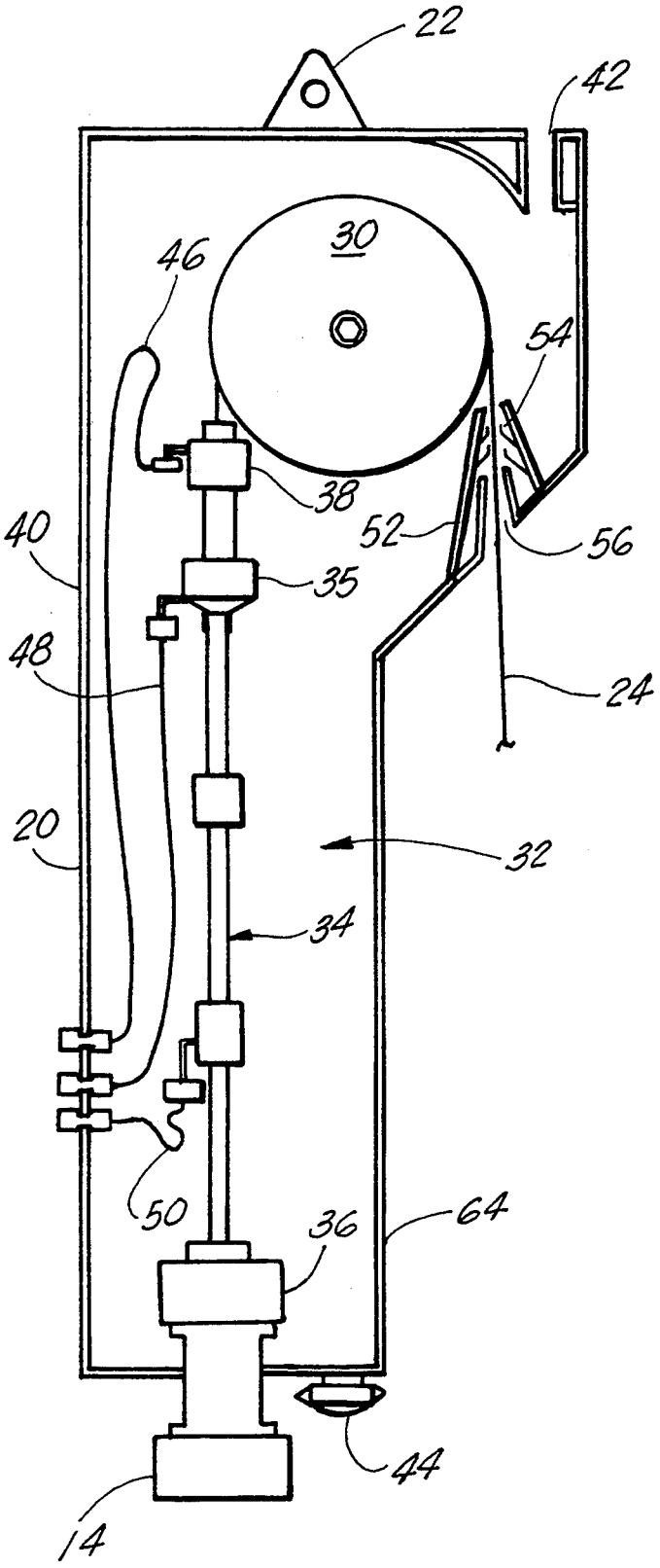
FIG. 2 is a pictorial view of the internal components of the present invention.
Figure 3:
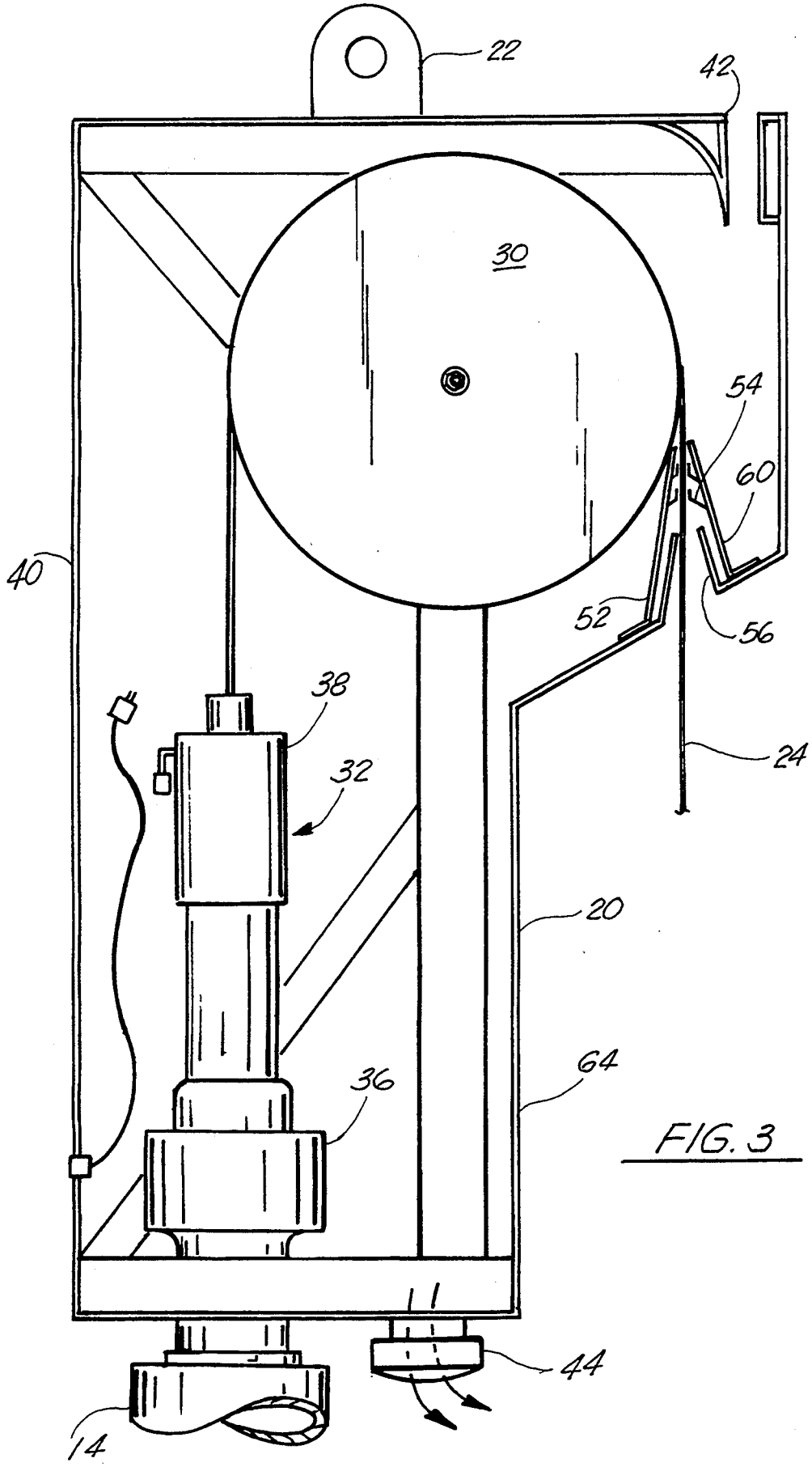
FIG. 3 is an alternate pictorial view of the internal components of the present invention.

Referring now more specifically to FIGS. 2 and 3, containment box 20 would preferably enclose both a top sheave 30 and various pressure control devices 32 located atop lubricator sections 14. These pressure control devices 32 can include such devices as grease injector heads 34, oil strippers 36 and/or packoffs 38 and the like. Packoffs 38 can have a bottom connection 35. In any event such pressure control devices 32 are generally only secured atop lubricator sections 14 for a short period of time. Pressure control devices 32, lubricator sections 14 and line clamps, seals or rams 16, 17 are all removed from the well when wireline operations conclude.

Containment box 20, as shown, incorporates housing or enclosure 40 which surrounds or encloses either all or a portion of pressure control devices 32 (such as grease injector heads 34, oil strippers 36 and/or packoffs 38, and the like). In this fashion, should a leak occur from one or more of pressure control devices 32, whether attached to a pressurized well or not, such leakage will be contained. The shape and/or length of housing 40 can also be altered as needed so as to enclose as much of or as little of pressure control devices 32 as desired.

Additionally, containment box 20 also encloses top sheave 30 around which wireline 24 passes during its journey from wireline unit 26 to wellhead 12. By enclosing top sheave 30, any contaminants adhering to wireline 24 as it travels around sheave 30 will also be contained within housing 40. The size of top sheave 30 can be adjusted as needed for any wireline size and for any desired configuration of housing 40.

Thus, by containing and/or enclosing one or more pressure control device 32 and top sheave 30 (and that portion of wireline 24 passing therebetween), any contaminants passing out of pressure control device 32 and/or falling from the exposed portion of wireline 24 are contained.

A vent 42 is configured within housing 40 to vent any pressure from the well and to prevent the explosion of contaminant box 20 upon a rapid and unexpected loss of pressure from the well. This vent 42 is typically secured to an upper region of housing 40 so as to prevent any collected pollutants or other contaminants ejected from the well from escaping containment box 20 via such vent 42. Thus, should a rapid pressure release occur from wellhead 12, vent 42 will permit such pressure to be released but will prevent any liquids from likewise escaping.

A drain 44 is generally secured to a lower region of housing 40 which funnels or directs any collected pollutants to a storage tank (not shown) for subsequent disposal. This drain 44 can also be screened as shown so as to only pass contaminants of a certain size. Thus, should an explosive ejection of pollutants from the well occur, these pollutants will be contained within housing 40 and safely discharged elsewhere for proper disposal. The same will occur for any pollutants that slowly accumulate within housing 40 such as by dripping or falling off wireline 24 or top sheave 30. Drain 44 is sized so as to permit oils and gases to vent to the storage tank without increasing the pressurization of containment box 20.

In the embodiment shown in FIG. 2, contained within enclosure 40 are various connecting hoses 46, 48, and 50 typically required for pressurized wellheads 12. Hose 46 is shown secured to the uppermost section of pressure control device 32 and it serves the purpose of supplying a pressurized medium to upper packoff 38. Hose 48 is the grease bleed line for the enclosed grease injector head 34 of pressure control device 32 while hose 50 is a grease injection hose for supplying pressurized grease to grease head 34 of pressure control device 32. FIG. 3 discloses packoff 38 and oil stripper 36 (36, 38 in combination is sometimes referred to as a "stripper" or "packoff") which, if desired, can be enclosed within housing 40 for use in wellheads 12 which are not pressurized.

Referring now more particularly to FIGS. 4, 5, 6 and 10 there is shown wireline drip collector 52 of containment box 20. Wireline 24 passes through this drip collector 52 on its way both to and from wireline unit 26. Wireline drip collector 52 is typically secured to a lower or bottom side of housing 40. It can be in the shape of a rectangle (FIG. 5) or it can be in the shape of a cone (FIG. 6), or any other shape as desired. In any event, wireline drip collector 52 consists, in this embodiment, of a series of concentric channels 54 surrounding and tapered with respect to wireline opening 56. These various channels 54 are configured to capture and retain therein any and all pollutants falling from wireline 24 as wireline 24 is moved around top sheave 30. Each concentric channel 54 is, in turn, open to the interior of containment box 20 so as to funnel or direct the collected contaminants toward drain 44. Thus, by reason of wireline 24 passing around top sheave 30 thereby discarding or shedding any contaminants it may contain, a "cleaned" wireline 24 is discharged from containment box 20. (Wireline 24 may not be totally "cleaned" because of the void areas between strands of wire that make up wireline, where contaminants collect. These remaining contaminants do not usually present a problem when wire is in a vertical position, whether wireline is moving or stationary.)

Figure 10:
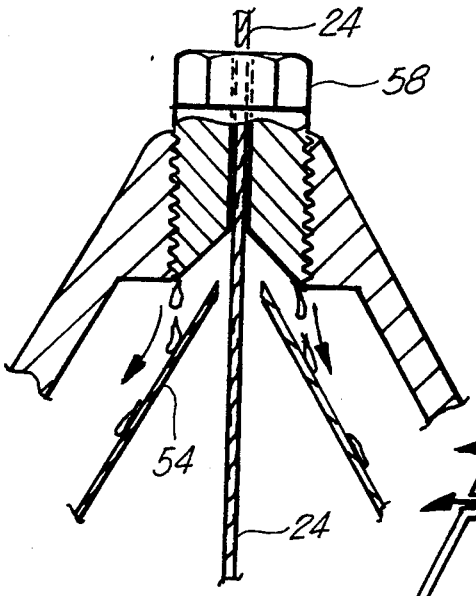
Figure 4:
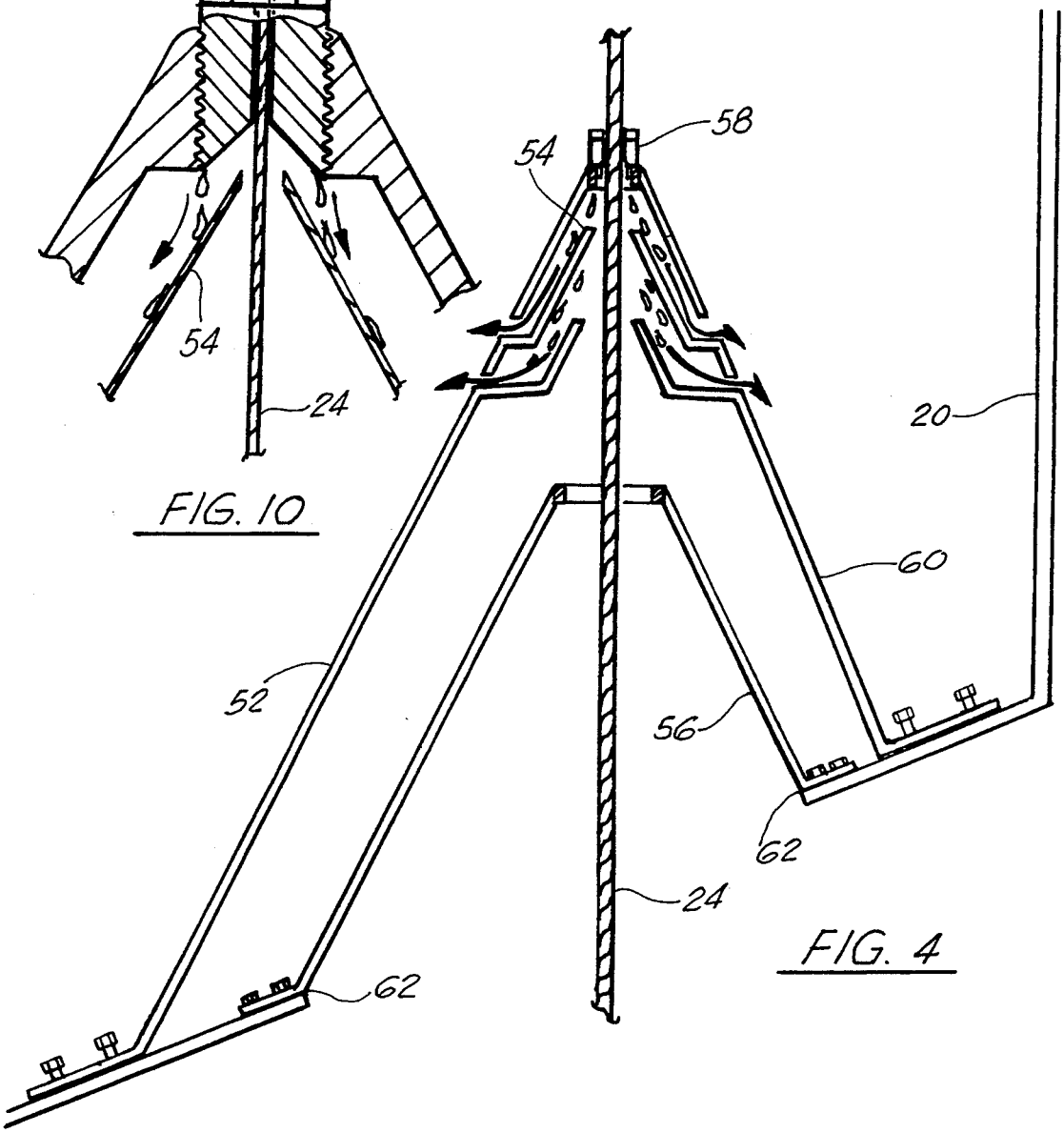
FIG. 4 is an enlarged pictorial view of the drip catch portion of the present invention.
Figure 5:
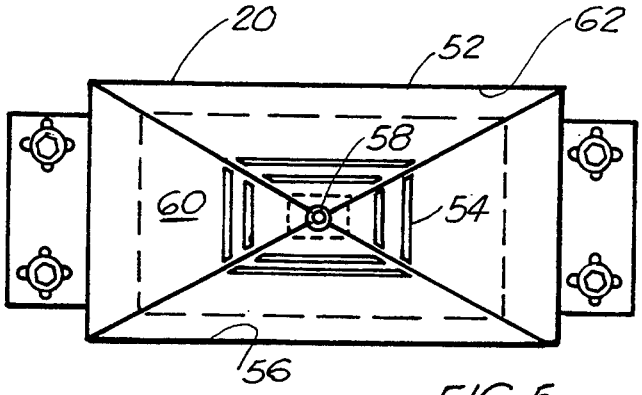
FIG. 5 is a bottom pictorial view of a rectangular drip catch portion of the present invention.

As best seen in FIGS. 4 and 10, an upper region of wireline drip collector 52 is configured to contain a small annular bushing or seal 58 through which wireline 24 passes. This bushing 58 will ideally thread into drip collector 52 and it serves the purpose of scrapping any contaminant off wireline 24 so as to enable such contaminant to fall downward into channels 54. Bushing 58 is configured so that should it become worn, it can be easily replaced. Of course, the size and shape of bushing 58 is dependant upon the size and shape of wireline 24 used.

Supports 60 for channels 54 are secured to housing 40 via bolts as shown. Generally, housing 40 is slotted (not shown) thereby enabling the final placement of supports 60 to be moved or adjusted as needed.

As illustrated in FIG. 4, wireline opening or passage 56 is tapered smaller with increasing height thereby providing a relatively large base region 62 through which wireline 24 passes. This large base region 62 enables wireline 24 to enter housing 40 from almost any practical angle needed, there being no need for containment box 20 to be retained in a specific position or alignment with respect to wireline unit 26.

Figure 7:
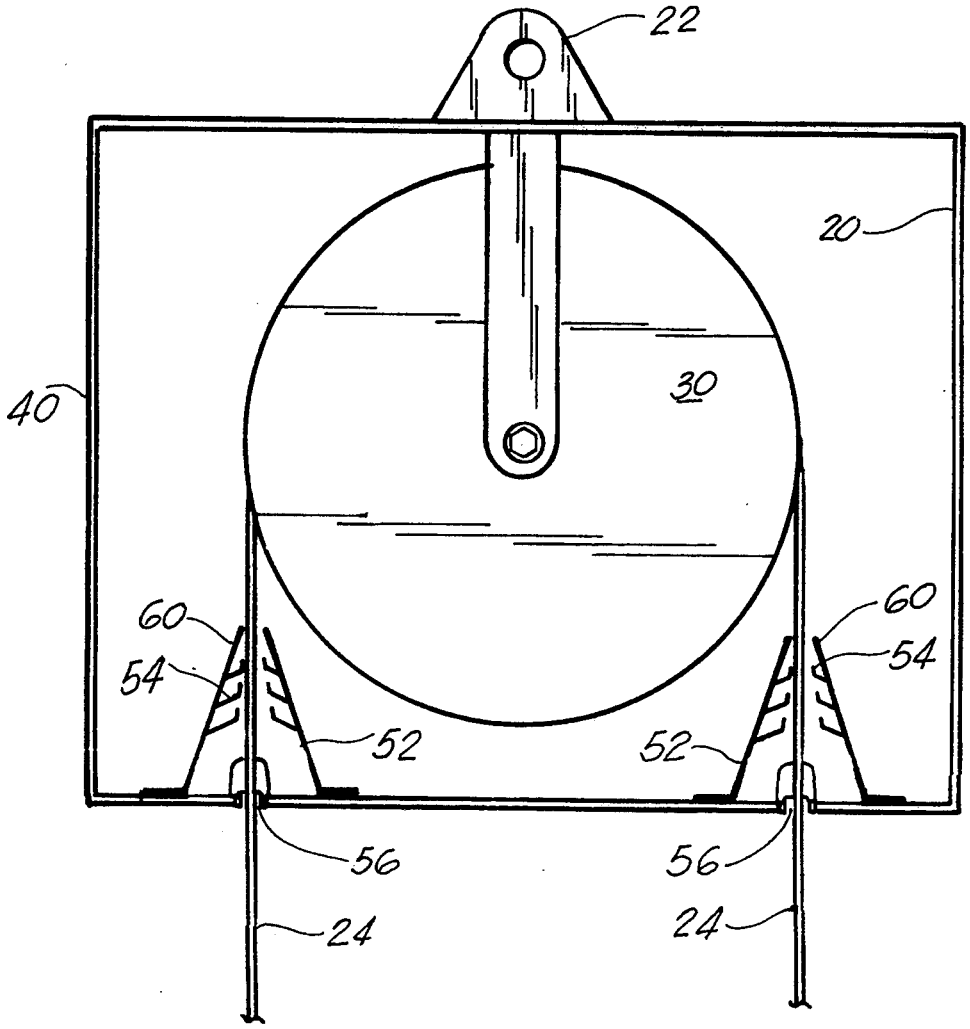
FIG. 7 is a pictorial view of the internal components of an alternate embodiment of the present invention.
Figure 6:
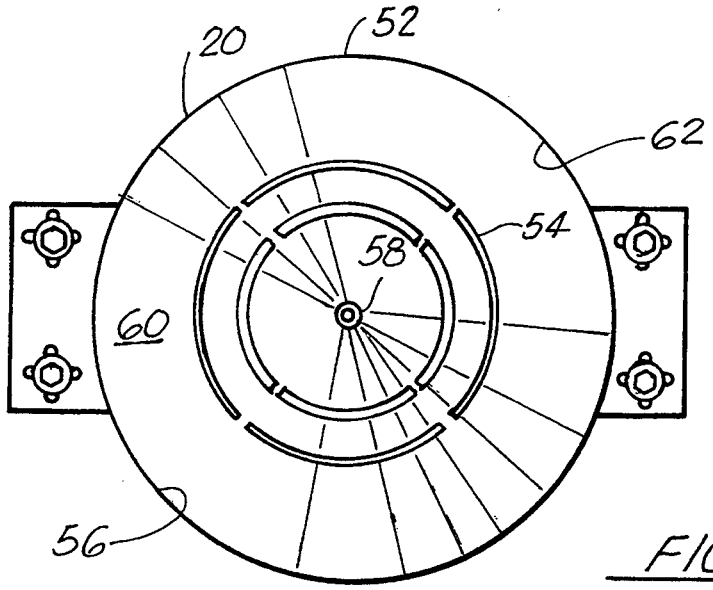
FIG. 6 is a bottom pictorial view of a circular drip catch portion of the present invention.

An alternate embodiment of containment box 20 is illustrated in FIG. 7. In this embodiment, containment box 20 only encloses top sheave 30 however, it also encompasses two separate wireline drip collectors 52, one on either side of top sheave 30. Consequently, housing 40 can be tailored solely to accommodate top sheave 30 and not any part of pressure control devices 32. In accordance with this embodiment, housing 40 is generally rectangular with no downward extension 64 so as to enclose underneath pressure control device 32. A reservoir would, of course, be provided so as to catch and capture any contaminants falling from enclosed top sheave 30. It is also optional whether housing 40 will also incorporate vent 42 and/or drain 44.

Figure 8:
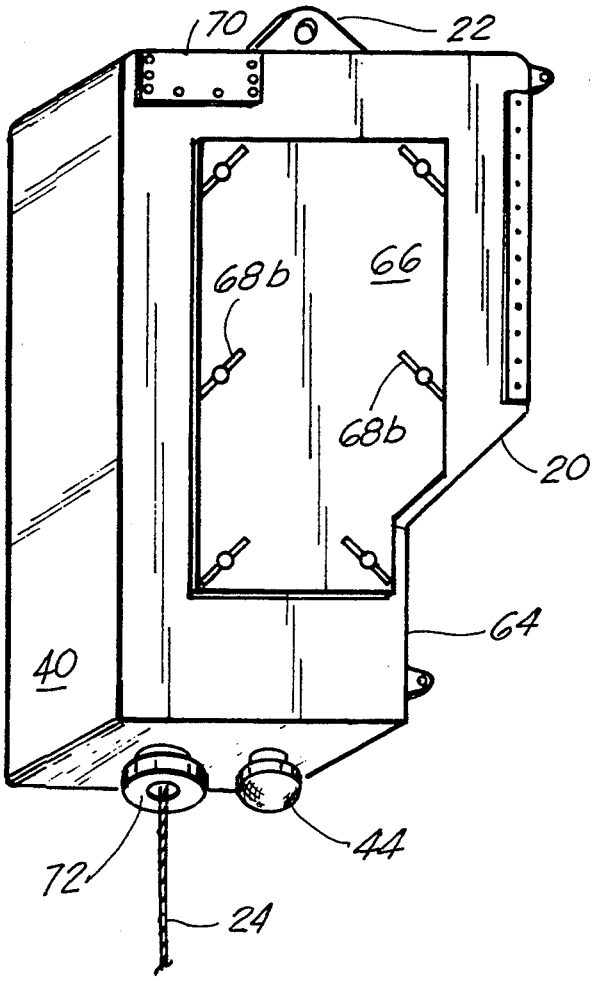
FIG. 8 is a pictorial view of the exterior housing of the present invention.
Figure 9:
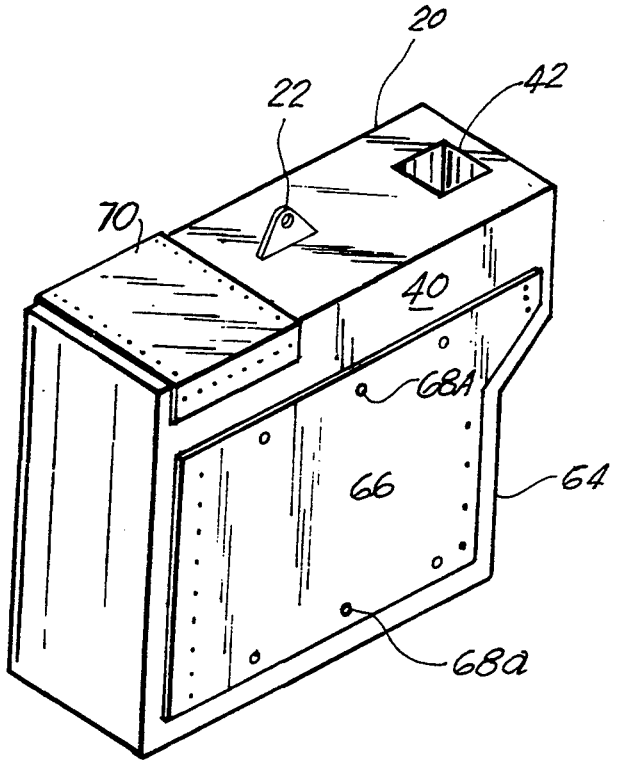
FIG. 9 is an alternate pictorial view of another configuration of the exterior housing of the present invention; and, FIG. 10 is an enlarged view of the upper portion of FIG. 4.

Referring now to FIGS. 8 and 9, there is shown the exterior of housing 40 of containment box 20. As stated above, the configuration of housing 40 can vary depending upon the various components to be enclosed. At the least, top sheave 30 will be contained and it will merely be a matter of desire whether any underneath pressure control devices 32 will likewise be enclosed. If such pressure control devices 32 are to be enclosed, then housing 40 will incorporate extension 64 which will thus surround these devices 32.

Access to the interior of containment box 20 to install and remove components therein is through field detachable door or hatch 66 which, in it normal state, remains sealed closed such as through the use of a gasket or the like. Bolts **68*a* or other fasteners 68*b* can be used to secure hatch 66 to housing 40**.

A separate pressure release panel 70 to be used when the wireline 24 blows out can also be incorporated into housing 40. This panel 70 will open solely upon the explosive release of contaminants from wellhead 12 so as to prevent any other break in the integrity of housing 40. Lower screened drain 44 is also illustrated as well as fitting 72 through which wireline 24 passes out of housing 40 on its journey to wellhead 12. In FIG. 9, upper vent 42 and attachment 22 are illustrated showing the single point of attachment 22 to crane 18. Furthermore, containment box 20 can be removed when no longer in use and can be installed in addition to other presently existing containment devices. Alternatively, containment box 20 can be the sole containment device with respect to wellhead 12.

One of the problems resolved by containment box 20 in containing contaminants that may be emitted from wellhead 12 and associated equipment is the ability to pressurize the connection between lubricator sections 14, grease head 34, and/or pack off 38 located within containment box 20 at a pressure of up to or greater than 1.5 times the required pressure.

Additionally, single point of connection 22, such as a pad eye at the top of containment box 20, will aid in supporting both lubricator sections 14 and sheave 30 to at least 1.5 times the breaking strength of wireline 24.

Also, a quickly detachable line clamp to hold the downwell tools in place within lubricator sections 14 can be used so as to facilitate the installation/removal of these sections 14.

Furthermore, containment box 20 is constructed so as to provide accurate alignment between top sheave 30 and the entry of wireline 24 into upper pressure control device 32 such as pack off 38. In this fashion, no additional stresses or friction is introduced to wireline 24 during operation.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A wireline wellhead containment enclosure comprising:

(a) a housing having attachment means secured thereto for supporting said housing above a wireline wellhead, and further having an interior and enclosing a sheave therein, said sheave being constructed and arranged for the passage of a wireline thereover;

(b) one or more wireline drip collector means movable with respect to said housing, positioned within and secured to said housing for the passage of said wireline into and out of said housing;

(c) channel means forming a part of said one or more wireline drip collector means for channelling collected contaminants to said interior of said housing; and, (d) seal means positioned above said channel means in said housing and secured to said one or more wireline drip collector means for engaging said wireline as it passes through said wireline drip collector means, whereby contaminants on said wireline are removed from said wireline and directed toward said channel means.

2. The apparatus as set forth in claim 1, wherein said housing is suspended at its top from supporting means.

3. The apparatus as set forth in claim 1 further comprising access means for gaining access to said interior of said housing.

4. The apparatus as set forth in claim 3, wherein said access means comprise an openable panel secured in place by a plurality of fasteners.

5. The apparatus as set forth in claim 3, wherein there are two separate wireline drip collector means each located on opposite sides of said sheave.

6. The apparatus as set forth in claim 3 further comprising vent means attached to said housing for venting the interior of said housing.

7. The apparatus as set forth in claim 6 further comprising drain means coupled to said interior of said housing for removing collected contaminants from said housing.

8. The apparatus as set forth in claim 7, wherein said drain means are screened thereby passing contaminants of only a certain size.

9. The apparatus as set forth in claim 7, wherein said housing also encloses at least a portion of a pressure control means affixed atop the wellhead for maintaining pressure within the wellhead.

10. The apparatus as set forth in claim 9, wherein said housing comprises a downward extension for enclosing said pressure control means.

11. The apparatus as set forth in claim 9, wherein said housing further comprises pressure release means for the rapid release of pressure from within said housing.

12. The apparatus as set forth in claim 9, wherein said pressure control means comprise a grease head.

13. The apparatus as set forth in claim 9, wherein said pressure control means comprise a pack off.

14. The apparatus as set forth in claim 9, wherein said pressure control means comprise an oil stripper.

15. A method of cleaning a wireline of a wireline wellhead comprising the steps of:

(a) positioning a contaminant enclosure above a wellhead;

(b) positioning a sheave within said contaminant enclosure and passing a wireline thereover, said wireline passing into and out of said enclosure;

(c) securing at least one wireline drip collector in said contaminant enclosure, said wireline drip collector being movable with respect to said contaminant enclosure and containing one or more channels therein;

(d) positioning seal means above said one or more channels in said housing and securing said means to said drip collector;

(e) removing contaminant from said wireline as said wireline passes through said wireline drip collector; and, (f) collecting said contaminant within said contaminant enclosure.

16. The method as set forth in claim 15 including the step of suspending said contaminant enclosure from a crane.

17. The method as set forth in claim 16 further comprising the step of enclosing at least a portion of a pressure control device located atop the wellhead.

* * * * *